US008354780B2

(12) United States Patent
Luo

(10) Patent No.: US 8,354,780 B2
(45) Date of Patent: Jan. 15, 2013

(54) LAMP DEVICE CAPABLE OF HEAT DISSIPATION

(75) Inventor: Chin-Kuang Luo, Taichung (TW)
(73) Assignee: Chin-Kuang Luo (TW)

( * ) Notice: Subject to any disclaimer, the term of this patent is extended or adjusted under 35 U.S.C. 154(b) by 202 days.

(21) Appl. No.: 13/022,332

(22) Filed: Feb. 7, 2011

(65) Prior Publication Data

US 2011/0221325 A1 Sep. 15, 2011

(30) Foreign Application Priority Data

Mar. 11, 2010 (TW) ..... 99107087 A

(51) Int. Cl.
*H01J 1/02* (2006.01)
*H01J 7/24* (2006.01)
*H01J 61/52* (2006.01)
*H01K 1/58* (2006.01)

(52) U.S. Cl. ..... 313/45; 313/11; 313/498; 362/294; 362/547; 362/264; 362/373; 362/218

(58) Field of Classification Search ..... 313/11, 313/45–46, 498; 362/294, 382, 391, 249.01–249.02, 362/249.11, 545, 257, 297, 299, 308, 800, 362/547, 264, 373, 218
See application file for complete search history.

(56) References Cited

U.S. PATENT DOCUMENTS

2010/0109499 A1* 5/2010 Vilgiate et al. ..... 313/1
2012/0170267 A1* 7/2012 Shang et al. ..... 362/235
2012/0243235 A1* 9/2012 Gao ..... 362/294

* cited by examiner

*Primary Examiner* — Anne Hines
*Assistant Examiner* — Jose M Diaz
(74) *Attorney, Agent, or Firm* — Banner & Witcoff, Ltd.

(57) ABSTRACT

A lamp device includes: a housing formed with heat-dissipating holes; a conductive connecting head mounted on a first side of the housing; a heat-conducting member mounted on a second side of the housing opposite to the first side, and having opposite first and second side surfaces; a lighting unit thermally contacting and mounted on the first side surface of the heat-conducting member, and covered by a transparent body; and a heat-dissipating layer made of an infrared radiating material. The heat-dissipating layer is disposed on and is in thermal contact with the second side surface of the heat-conducting member. Heat generated by the lighting unit is transmitted by the first heat-conducting member to the heat-dissipating layer, and is dissipated by the heat-dissipating layer through the heat-dissipating holes in the housing.

12 Claims, 5 Drawing Sheets

LAMP DEVICE CAPABLE OF HEAT DISSIPATION

CROSS-REFERENCE TO RELATED APPLICATION

This application claims priority of Taiwanese Application No. 099107087, filed on Mar. 11, 2010.

BACKGROUND OF THE INVENTION

1. Field of the Invention

The invention relates to a lamp device, and more particularly to a lamp device capable of heat dissipation.

2. Description of the Related Art

FIG. 1 illustrates a conventional light emitting diode (LED) lamp 1 that includes a metal housing 11 having opposite first and second sides 111, 112, a plurality of LEDs (not shown) mounted in the metal housing 11 and disposed adjacent to the second side 112 of the housing 11, a conductive connecting head mounted on the first side 111 of the housing 11, and a transparent bulb body 13 mounted on the second side 112 of the housing 11 for covering the LEDs. In such a configuration, heat generated by the LEDs is dissipated by the metal housing 11. The temperature of the metal housing 11 may become very high during use due to heat accumulation. Therefore, when a user's hand touches the metal housing 11 with high temperature, an injury to the user's hand may be incurred.

SUMMARY OF THE INVENTION

Therefore, an object of the present invention is to provide a lamp device that has a superior heat dissipating capability and that can overcome the aforesaid drawback of the prior art.

According to the present invention, a lamp device comprises:

a housing having opposite first and second sides, and formed with a plurality of heat-dissipating holes;

a conductive connecting head mounted on the first side of the housing;

a first heat-conducting member mounted on the second side of the housing, the first heat-conducting member having a first side surface exposed outward of the housing, and a second side surface opposite to the first side surface and disposed in the housing;

a lighting unit thermally contacting and mounted on the first side surface of the first heat-conducting member;

a first heat-dissipating layer made of an infrared radiating material, the first heat-dissipating layer thermally contacting and being disposed on the second side surface of the first heat-conducting member; and a transparent cap body mounted on the second side of the housing for covering the lighting unit.

Heat generated by the lighting unit is transmitted by the first heat-conducting member to the first heat-dissipating layer, and is dissipated by the first heat-dissipating layer through the heat-dissipating holes in the housing.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
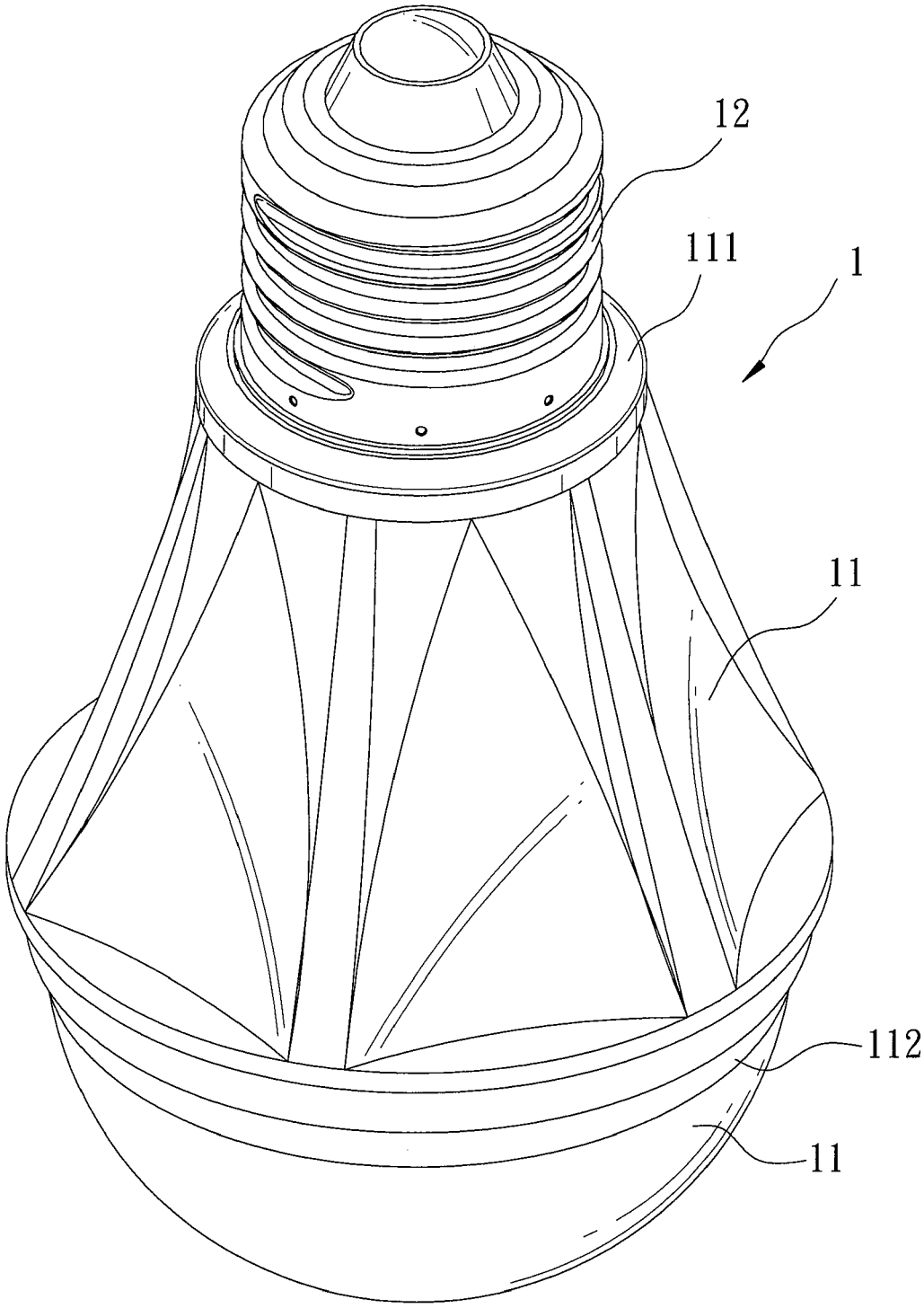
FIG. 1 PRIOR ART
FIG. 1 is a perspective view of a conventional light emitting diode lamp.

Before the present invention is described in greater detail, it should be noted that like elements are denoted by the same reference numerals throughout the disclosure.

Figure 2:
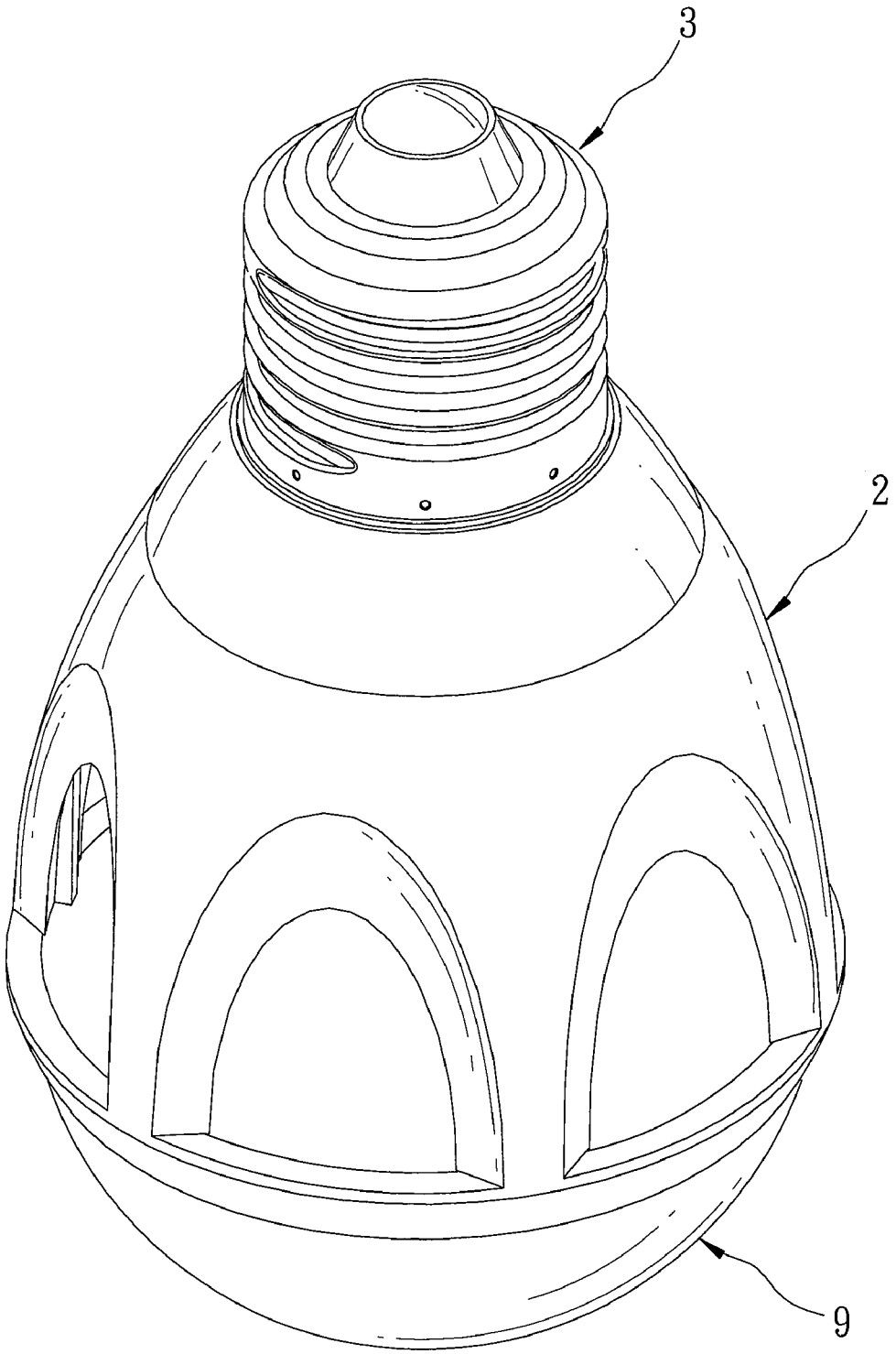
FIG. 2 is a perspective view showing the first preferred embodiment of a lamp device according to the present invention.
Figure 3:
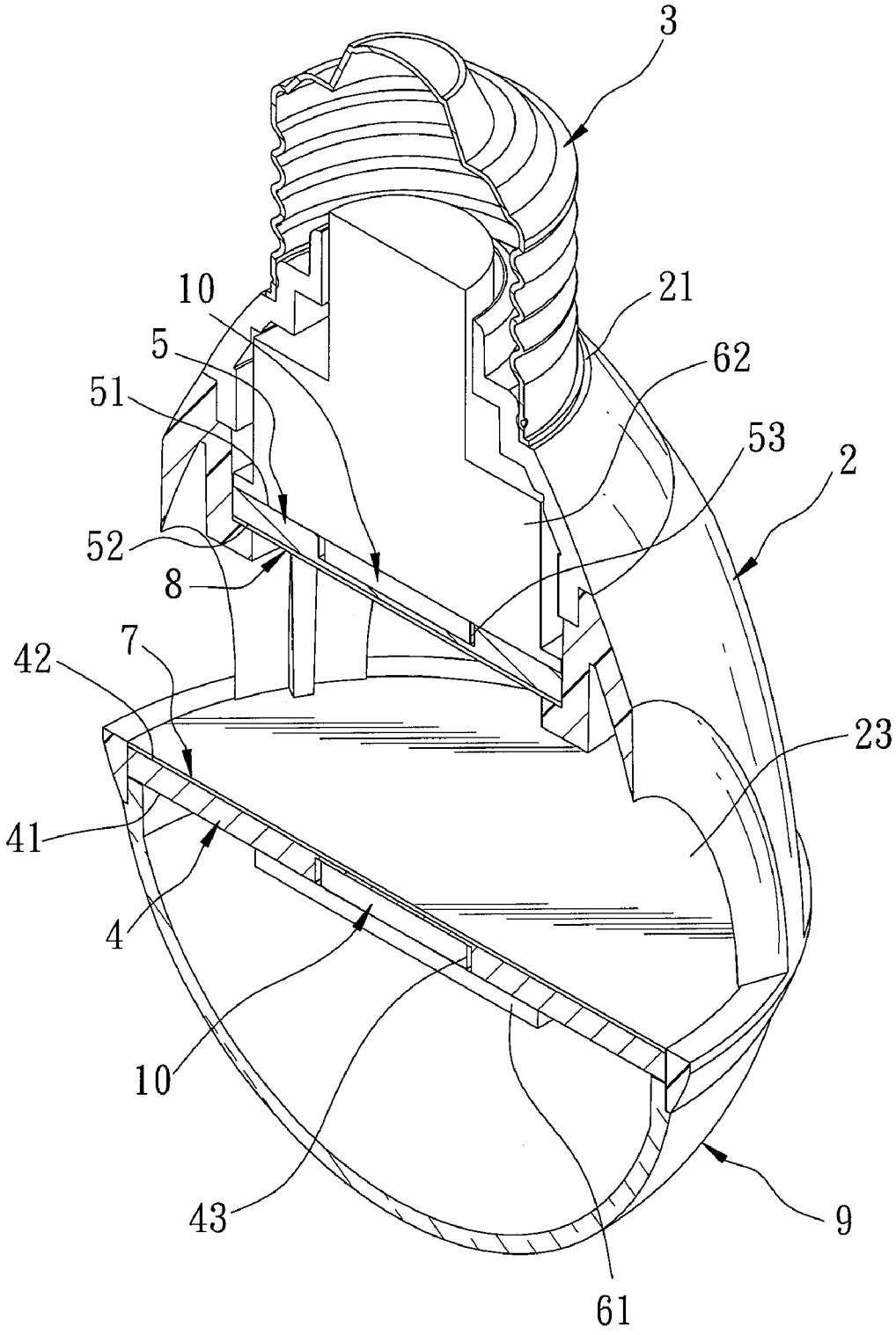
FIG. 3 is a perspective, partly schematic sectional view showing the first preferred embodiment; cutaway

Referring to FIGS. 2 and 3, the first preferred embodiment of a lamp device according to the present invention is shown to include a housing 2, a conductive connecting head 3, a first heat-conducting member 4, a second heat-conducting member 5, a lighting unit 61, a circuit unit 62, a first heat-dissipating layer 7, a second heat-dissipating layer 8, a transparent cap body 9, and two ultrasonic vibrators 10.

The housing 2 has a first side 21 mounted with the connecting head 3 thereon, and a second side 22 opposite to the first side 21. The housing 2 is made of plastic, and is formed with a plurality of heating-dissipating holes 23.

The connecting head 3 is mounted on the first side 21 of the housing 2, and is adapted to be mounted in a lamp seat for a light bulb (not shown).

The first heat-conducting member 4 is mounted on the second side 22 of the housing 2. The first heat-conducting member 4 has a first side surface 41 exposed outward of the housing 2, and a second side surface 42 opposite to the first side surface 41 and disposed in the housing 2. In this embodiment, the first heat-conducting member 4 is in the form of a plate. Each of the first and second side surfaces 41, 42 is a flat surface. The first heat-conducting member 4 is formed with an inner receiving space 43.

The second heat-conducting member 5 is disposed in the housing 2. The second heat-conducting member 5 has a first side surface 51 disposed adjacent to the first side 21 of the housing 2, and a second side surface 52 facing the second side surface 42 of the first heat-conducting member 4. In this embodiment, the second heat-conducting member 5 is in the form of a plate. Each of the first and second side surfaces 51, 52 is a flat surface. The second heat-conducting member 5 is formed with an inner receiving space 53.

Each of the first and second heat-dissipating layers 7, 8 is made of an infrared radiating material, and is coated on and is in thermal contact with the second side surface 42, 52 of a corresponding one of the first and second heat-conducting members 4, 5.

The lighting unit 61 is mounted on and is in thermal contact with the first side surface 41 of the first heat-conducting member 4. In this embodiment, the lighting unit 61 includes a plurality of LEDs (not shown). Thus, heat generated by the lighting unit 61 is transmitted by the first heat-conducting member 4 to the first heat-dissipating layer 7, and is dissipated by the first heat-dissipating layer 7 through the heat-dissipating holes 23 in the housing 2.

The circuit unit 62 is disposed in the housing 2, and is mounted on and in thermal contact with the first side surface 51 of the second heat-conducting member 5. The circuit unit 62 is coupled to the lighting unit 61 and the conductive connecting head 3 for activating the lighting unit 61. Thus, heat generated by the circuit unit 62 is transmitted by the second heat-conducting member 5 to the second heat-dissipating layer 8, and is dissipated by the second heat-dissipating layer 8 through the heat-dissipating holes in the housing 2.

The ultrasonic vibrators 10 are received respectively in the inner receiving spaces 43, 53 in the first and second heat-conducting members 4, 5. Ultrasonic vibration generated by the ultrasonic vibrators 10 can improve a heat dissipating efficiency of the heat-dissipating layers 7, 8.

The cap body 9 is mounted on the second side 22 of the housing 2 for covering the lighting unit 61. In this embodiment, the cap body 9 cooperates with the housing 2 to constitute a bulb body.

In such a configuration, due to the presence of the first and second heat-conducting members 4, 5, the first and second heat-dissipating layers 7, 8, the ultrasonic vibrators 10, and the heat-dissipating holes 23, the lamp device of the present invention has superior heat dissipating capability. In addition, since plastic has a lower heat conduction coefficient than that of metal, the housing 2 has a relatively low temperature during use, thereby avoiding an injury to a user's hand as encountered in the prior art.

Figure 4:
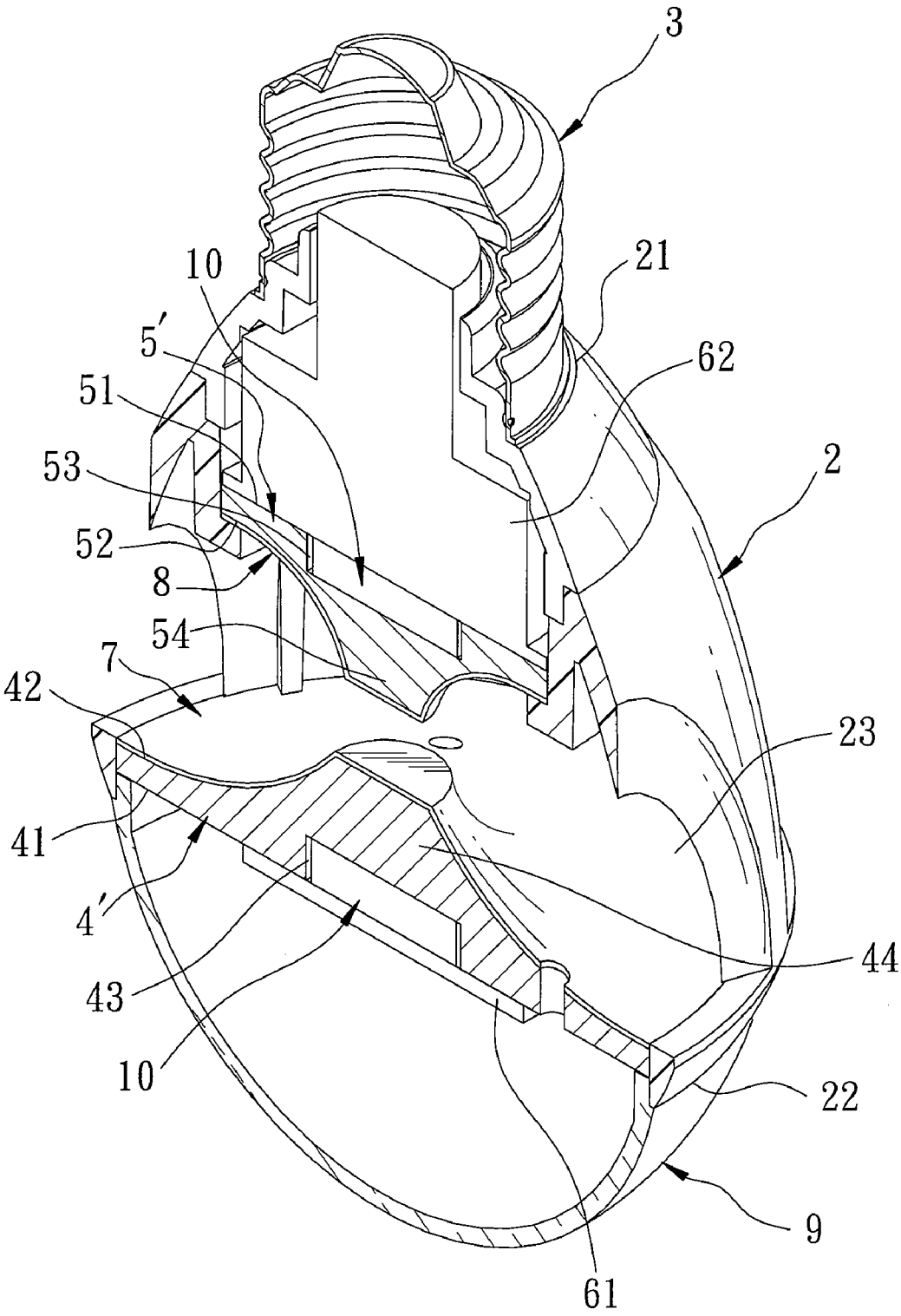
FIG. 4 is a perspective, partly schematic sectional view showing the second preferred embodiment of a lamp device according to the present invention.

FIG. 4 illustrates the second preferred embodiment of a lamp device according to this invention, which is a modification of the first preferred embodiment. In this embodiment, each of the first and second heat-conducting members 4', 5' further has a protrusion 44, 54 projecting from the second side surface 42, 52 thereof toward the other one of the first and second heat-conducting members 4', 5'. The protrusions 44, 54 of the first and second heat-conducting members 4', 5' are truncated cone-shaped, and are spaced apart from each other.

The second side surface 42 and the protrusion 44 of the first heat-conducting member 4' are covered with the first heat-dissipating layer 7. The second side surface 52 and the protrusion 54 of the second heat-conducting member 5' are covered with the second heat-dissipating layer 8.

Figure 5:
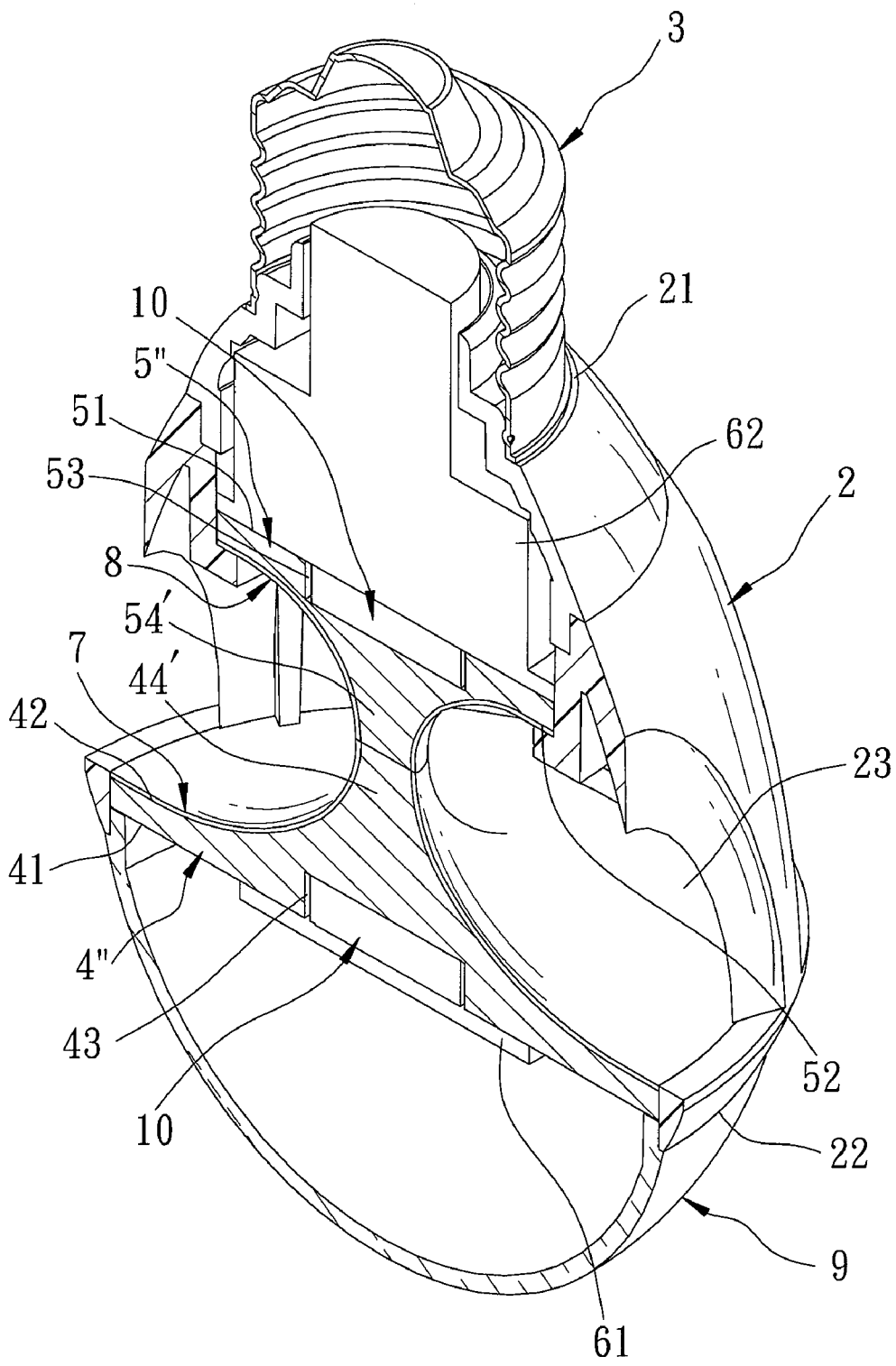
FIG. 5 is a perspective, partly schematic sectional view showing the third preferred embodiment of a lamp device according to the present invention.

FIG. 5 illustrates the third preferred embodiment of a lamp device according to this invention, which is a modification of the second preferred embodiment. Unlike the second preferred embodiment, the protrusions 44', 54' of the first and second heat-conducting members 4", 5" contact each other. Alternatively, the first and second heat-conducting members 4", 5" are integrally formed, and the first and second heat-dissipating layers 7, 8 are integrally formed.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A lamp device comprising:

a housing having opposite first and second sides, and formed with a plurality of heat-dissipating holes;

a conductive connecting head mounted on said first side of said housing;

a first heat-conducting member mounted on said second side of said housing, said first heat-conducting member having a first side surface exposed outward of said housing, and a second side surface opposite to said first side surface and disposed in said housing;

a lighting unit thermally contacting and mounted on a said first side surface of said first heat-conducting member;

a first heat-dissipating layer made of an infrared radiating material, said first heat-dissipating layer thermally contacting and being disposed on said second side surface of said first heat-conducting member; and a transparent cap body mounted on said second side of said housing for covering said lighting unit;

wherein heat generated by said lighting unit is transmitted by said first heat-conducting member to said first heat-dissipating layer, and is dissipated by said first heat-dissipating layer through said heat-dissipating holes in said housing.

2. The lamp device as claimed in claim 1, wherein:

said first heat-conducting member is in the form of a plate, and each of said first and second side surfaces is a flat surface; and said second side surface of said first heat-conducting member is covered with said first heat-dissipating layer.

3. The lamp device as claimed in claim 1, wherein:

said first heat-conducting member further has a protrusion projecting from said second side surface toward said first side of said housing; and said second side surface and said protrusion of said first heat-conducting member are covered with said first heat-dissipating layer.

4. The lamp device as claimed in claim 3, wherein said protrusion of said first heat-conducting member is truncated cone-shaped.

5. The lamp device as claimed in claim 1, wherein said first heat-conducting member is formed with an inner receiving space, said lamp device further comprising an ultrasonic vibrator received in said inner receiving space in said first heat-conducting member.

6. The lamp device as claimed in claim 1, further comprising:

a second heat-conducting member disposed in said housing, said second heat-conducting member having a first side surface disposed adjacent to said first side of said housing, and a second side surface facing said second side surface of said first heat-conducting member;

a circuit unit disposed in said housing, said circuit unit thermally contacting and being mounted on said first side surface of said second heat-conducting member, said circuit unit being coupled to said lighting unit and said conductive connecting head for activating said lighting unit; and a second heat-dissipating member made of an infrared radiating material, said second heat-dissipating member thermally contacting and being disposed on said second side surface of said second heat-conducting member;

wherein heat generated by said circuit unit is transmitted by said second heat-conducting member to said second heat-dissipating layer, and is dissipated by said second heat-dissipating layer through said heat-dissipating holes in said housing.

7. The lamp device as claimed in claim 6, wherein:

each of said first and second heat-dissipating members is in the form of a plate, each of said first and second side surfaces of each of said first and second heat-dissipating members is a flat surface; and said second side surfaces of said first and second heat-conducting members are covered with said first and second heat-dissipating layers, respectively.

8. The lamp device as claimed in claim 6, wherein:

each of said first and second heat-conducting members further has a protrusion projecting from said second side surface thereof toward the other one of said first and second heat-conducting members; and said second side surface and said protrusion of each of said first and second heat-conducting members are covered with a corresponding one of said first and second heat-dissipating layers.

9. The lamp device as claimed in claim 8, wherein said protrusions of said first and second heat-conducting members are truncated cone-shaped.

10. The lamp device as claimed in claim 8, wherein said protrusions of said first and second heat-conducting members contact each other.

11. The lamp device as claimed in claim 6, wherein each of said first and second heat-conducting members is formed with an inner receiving space, said lamp device further comprising two ultrasonic vibrators each received in said inner receiving space in a corresponding one of said first and second heat-conducting members.

12. The lamp device as claimed in claim 1, wherein said housing is made of plastic.

* * * * *